US005469203A

United States Patent [19]

Hauschild

[11] Patent Number: 5,469,203

[45] Date of Patent: Nov. 21, 1995

[54] PARASITIC RESISTANCE COMPENSATION FOR A THERMAL PRINT HEAD

[75] Inventor: Edward Hauschild, Rochester, N.Y.

[73] Assignee: Eastman Kodak Company, Rochester, N.Y.

[21] Appl. No.: 981,045

[22] Filed: Nov. 24, 1992

[51] Int. Cl.[6] ..... B41J 2/325

[52] U.S. Cl. ..... 347/190; 358/298

[58] Field of Search ..... 346/76 PH; 400/120; 358/298; 347/190

[56] References Cited

U.S. PATENT DOCUMENTS

| | | | |
|---|---|---|---|
| 4,322,733 | 3/1982 | Moriguchi et al. | 346/76 PH |
| 4,540,991 | 9/1985 | Kariya et al. | 346/76 |
| 4,573,058 | 2/1986 | Brooks | 346/76 PH |
| 4,786,917 | 11/1988 | Hauschild et al. | 346/76 |
| 4,827,281 | 5/1989 | Lubinsky et al. | 346/1.1 |
| 4,887,092 | 12/1989 | Pekruhn et al. | 346/76 |
| 4,996,487 | 2/1991 | McSparran et al. | 324/549 |
| 5,053,790 | 10/1991 | Stephenson et al. | 346/76 |
| 5,109,235 | 4/1992 | Sasaki | 346/76 |
| 5,163,760 | 11/1992 | Nardozzi | 400/120 |

FOREIGN PATENT DOCUMENTS 0452928 10/1991 European Pat. Off. .

*Primary Examiner*—Huan H. Tran
*Attorney, Agent, or Firm*—Milton S. Sales

[57] ABSTRACT

A compensation method and apparatus which achieves, despite parasitic voltage drops caused by a portion of all heating elements in a print line, the desired print density for a given heating element or pixel when multiple heating elements are enabled. A weighted average of the desired digital level of all heat elements in a print line is used to determine an offset power level, which then is used to compensate for power variations at each heat element by adjusting the number of digital signals to each heating element according to the offset power level. This adjustment results in an actual achieved print density that is equivalent to the desired density, despite complications caused by print lines having different desired densities but equivalent density averages.

12 Claims, 7 Drawing Sheets

PARASITIC RESISTANCE COMPENSATION FOR A THERMAL PRINT HEAD

BACKGROUND OF THE INVENTION

1. Field of the Invention

The present invention relates generally to thermal printers and, more particularly, to thermal printers which compensate for variations in power supplied to a multiple heating element thermal print head.

2. Description of the Related Art

As is well known in the art, a thermal print head utilizes a row of closely spaced resistive heat generating elements, known as thermal print elements, which are selectively energized to record data in hard copy form. The data may comprise stored digital information relating to text, bar codes or graphic images. In operation, the thermal print elements receive energy from a power supply through driver circuits in response to the stored digital information. The heat from each energized element can be applied directly to thermal sensitive material or can be applied to a dye-coated web to cause diffusion transfer of the dye to paper or other receiver material. The Kodak XL7700 digital continuous tone printer contains such thermal print elements and operates in this fashion.

The transfer of dye from the web to a picture element, known as a pixel, on the receiver material is a function of the power dissipated in the associated resistive heat generating element. The power dissipated in a thermal print element is equal to the square of the voltage drop across the thermal print element divided by the resistance of the element.

A typical single density image printer is shown functionally in FIG. 1. In the printing mode, an electrical voltage from the power supply, Vs, is applied across the thermal print elements Rel–Ren. The electronic circuitry that permits current to pass through one or more of the elements in a given time interval exists in the printer and is necessary to perform the printing function. For the purpose of this description, the circuitry can be simplified to a shift register SRl–Rn, enable signal El, logical gates 'ANDl'–'ANDn', and transistor switches Tl–Tn. The complexity of this electronic circuitry varies for different printers; however, each printer has the same functionality for heating of the resistive elements.

In the printing mode, the shift register SRl–SRn is loaded with a logical "1" at each location corresponding to a pixel where there is a desire to form an optical density, ie. a transfer of dye material. The outputs of the shift register SRl–SRn are logically 'AND'ed with an enable pulse E1 in the logic gates 'ANDl'–'ANDn.' The enable pulse E1 is formed to represent the duration that a current is desired to pass through the thermal print elements Rel–Ren. The output of the logic gates 'ANDl'–'ANDn' biases transistor switches Tl–Tn to allow current to pass through the corresponding thermal print elements Rel–Ren to ground. The energy transferred to the media to form an optical density is typically a function of the voltage drop across the thermal print element and the duration of either a constant current or a pulse count that is allowed to pass through the thermal print element. In other words, the heat generated by a thermal print element can be varied by controlling the pulse width of the current to that thermal print element or by controlling the pulse count to that thermal print element. Pulse width variation provides greater resolution than pulse count variation, but pulse width variation requires more complex algorithms than pulse count variation.

The relationship of the optical density formed at a pixel to the energy dissipated in the associated thermal print element is calibrated and is expected to remain constant during the time interval between calibrations. However, the voltage applied to the thermal print element varies with the total current drawn in the printer circuit. If the voltage applied to the thermal print element is changed by, for instance, imperfections in the power supply, switches, or distribution system, or by difficult to compute resistances in the printer circuit, the relationship between the optical density formed at a pixel to the power dissipated in the associated thermal print element is also modified. These imperfections of the circuit cause a variable parasitic resistance which creates parasitic voltage drops that are related to the number of print elements activated for a print line, thereby unpredictably altering the power delivered to the print element. This power alteration results in an unpredictable or undesirable change in the optical density formed at the pixel. This change may be evident as either an increase or decrease in the optical density of the pixel.

Numerous attempts have been made to correct automatically for resistance variations, which vary over time, between thermal print elements and parasitic resistance drops in the power distribution bus inside the thermal head. Most thermal printers incorporate driver and other circuitry that control print operations so that obtaining access to the contacts of individual print head resistive heating elements is difficult. Alternatively, determining the voltage at the terminals of the print head connectors is relatively easy. However, as described, the voltage across the print head includes parasitic drops across power supply lines, interconnections, and other wiring internal to the print head. As further described, these parasitic voltage drops are related to the number of thermal print elements activated for a print line. As a result, the parasitic voltage drops vary considerably as the number of selected heating elements changes. The varying thermal print element voltage produces noticeable variations in density of the imprinted picture elements.

U.S. Pat. No 5,053,790, issued in the name of Stephenson, assigned to the assignee of the present invention, and which is hereby incorporated herein by reference in its entirely, addresses these problems and the relevant art and proposes solutions which involve the maintenance of a substantially constant voltage across the selected resistive heat elements, independent of the number of selected heat elements in any given printing line. Several other techniques have been proposed to prevent these variations and the consequent variation of the density of their resultant print. These techniques include employing separate power sources for each of the heating elements forming a thermal print head, providing an individual balancing resistor for each of the heating elements in the head, and adjusting the electrical power applied to each of the resistive elements following production of an unacceptable print. U.S. Pat. No. 4,540,991, issued in the name of Kariya, briefly identifies these relevant art approaches and sets forth a further proposal to employ a resistance value variation detector selectively connected to each of the resistive elements in order to derive compensation data based upon resistance variation in the elements. The actual resistance values are retained in a memory at addresses corresponding to each of the resistive elements in the print head and each value is multiplied by a compensation signal to compensate thereby the printing data for each element before that data is applied to the shift register stages of the thermal print head. A similar technique is disclosed in U.S. Pat. No. 4,887,092, issued in the name of Pekruhn, and U.S. Pat. No. 4,996,487, issued in the name of McSparran, where the resistance check values are employed diagnostically or employed to indicate the temperature of the resistive element between each printing line.

Moreover, U.S. Pat. No. 4,786,917, issued in the name of Hauschild, teaches a simple but effective signal processing improvement for a thermal printer which provides enhanced continuous tone dye density images. However, none of the aforementioned patents addresses the problem of correcting for power supply loading caused by parasitic voltage drops. These voltage drops are related to the number of print elements turned on for a print line. The parasitic voltage drops vary the power delivered to each print element, thereby producing noticeable variations in density of the imprinted picture elements or pixels. When more than one heating element is activated, the loading of the electrical circuit varies with the number of elements activated. This loading variation causes the power that the individual heating element receives to vary, which in turn causes the density of the printed pixel to vary from the desired value. Since this loading variation results from a number of different factors, the precise variation during any activation of more than one heating element can be difficult to compute. For instance, the resistance of one heating element can vary slightly from that of another heating element. Further, because resistance changes with temperature, the multiplicity of connections between all of the heating elements add a further specific resistance that causes the power supply voltage to vary. As previously mentioned, if the voltage applied to the thermal print element is changed by some mechanism, such as these difficult to compute resistances, the relationship between the optical density formed at a pixel to the power dissipated in the associated thermal print element is also modified. The result of this change is that the optical density formed at the pixel is not the desired optical density. This change may be evident as either an increase or decrease in the optical density of the pixel.

In addition, U.S. Pat. No. 5,109,235, issued in the name of Sasaki, teaches a recording density correcting apparatus in a recorder for performing a recording operation at a multiple gradation by a thermal head having a plurality of heating resistors. Sasaki determines how many pulses go to each heating element at the start, and then constructs a histogram to adjust the number of supplied pulses depending on the voltage shown by the histogram. However, Sasaki does not address the problem of adjusting for only a portion of heating elements instead of all of them at once.

Consequently, a need has been felt for providing an apparatus and method which overcomes the variations in image density from the desired density due to the unpredictable parasitic resistance encountered from a portion of a plurality of heat generating elements activated in a thermal print head.

SUMMARY OF THE INVENTION

It is therefore an object of the present invention to provide an improved thermal print head control apparatus and method.

It is a feature of the present invention to provide an improved thermal print head control apparatus and method which achieves the desired print density for a given pixel when multiple heating elements are enabled. This feature is achieved by adjusting the digital signals to each heating element to compensate for the print elements enabled in each print line operation. This adjustment is accomplished by adjusting the desired digital signal with a weighting function to achieve the needed compensation.

A method and apparatus which compensates for the power supply loading effect caused by energizing a plurality of heating elements must be simple and fast enough to be performed in real time during the line printing operation. Possible variables for compensation include head voltage, pulse width and the digital levels of each signal sent to each heating element. Head voltage variations are possible, but entail considerable hardware cost increases. As previously described, the power dissipated in a thermal print element is equal to the square of the voltage drop across the thermal print element divided by the resistance of the element. However, as described, when a plurality of print elements are included in the print head, the voltage across the print head includes parasitic voltage drops across power supply lines, interconnections and other wiring internal to the print head. These parasitic voltage drops are related to the number of print elements activated for a print line. As a result, the parasitic voltage drops vary considerably as the number of selected heating elements changes. This varying heat element parasitic voltage is compensated for by the present invention by adjusting the pulse count to be applied to each individual heating element with an offset power level value calculated from a weighted average value of the total current pulses to be distributed among the total pixels in a print line.

An advantage of the present invention is that actual printed pixel densities more closely achieve the desired pixel density as a result of compensation for power supply loading. Consequently the density variations resulting from power supply loading are minimized between print lines. The compensation for power supply loading can be implemented without significantly reducing printer speed using the present invention. Therefore, a preferred method to deliver power to the thermal print elements is by increasing or decreasing the delivered pulses to each enabled heating element in a given period of time.

BRIEF DESCRIPTION OF THE DRAWINGS

The advantages and features of the present invention will become, better understood with reference to the following more detailed description and claims taken in conjunction with the accompanying drawings in which like elements are identified with like symbols and in which:

DESCRIPTION OF THE PREFERRED EMBODIMENTS

1. Detailed Description of the Figures

Figure 1:
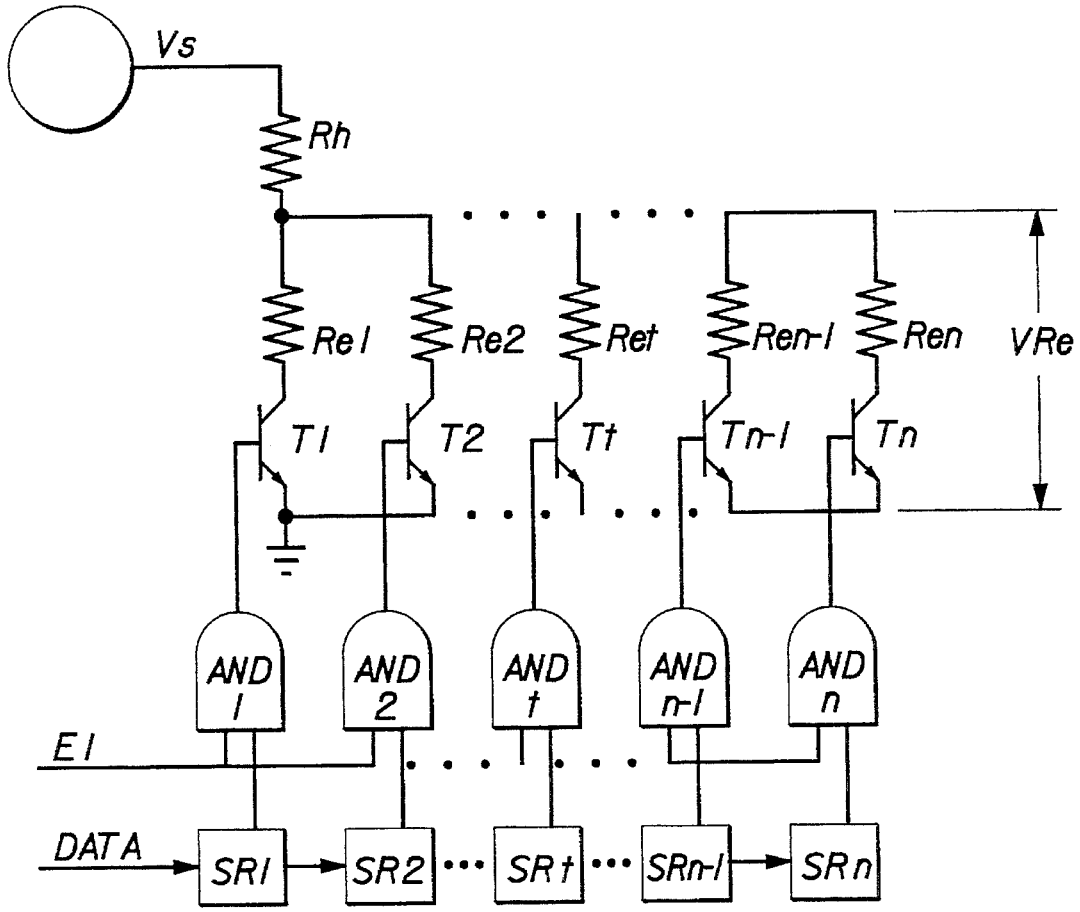
FIG. 1 is a functional schematic diagram of a typical thermal print head.
Figure 2:
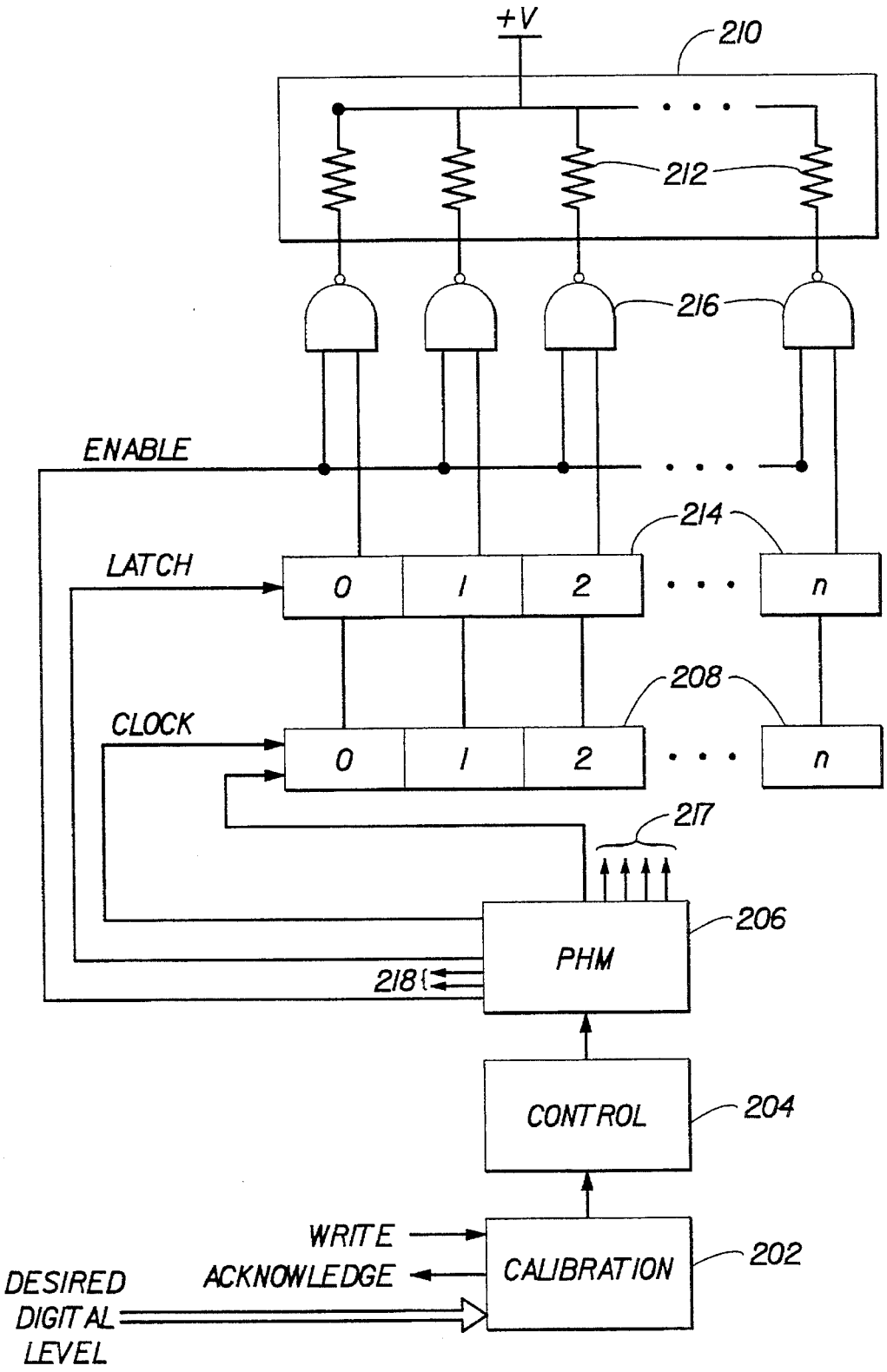
FIG. 2 is a functional schematic diagram of a typical thermal print head shown along with elements in the control circuitry which operate to compensate a desired digital level input signal in accordance with the present invention.
Figure 4:
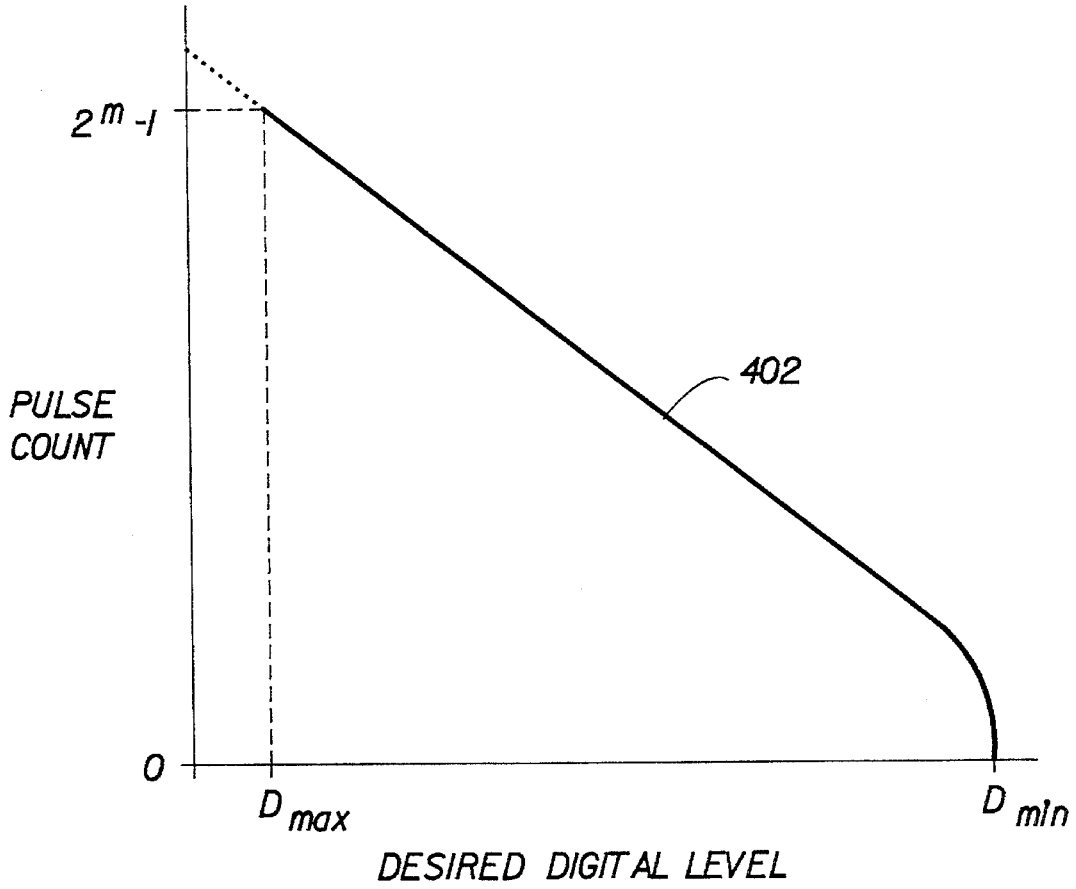
FIG. 4 is a plot of the function used by a calibration element of FIG. 2 to translate a desired digital level input into a pixel-specific number of pulses.

Referring now to FIG. 2, a calibration element 202 receives a write signal, a clock signal, and specified data signals over a data bus (not shown) from a microcomputer (not shown) which controls the printer. The data signals are 8-bit digital signals or words which each represent a pixel-specific desired digital level of dye density. The calibration element 202 applies a calibration function (shown in FIG. 4) to the desired digital level input in order to translate the pixel-specific desired digital level into a corresponding pixel-specific pulse count to be applied to that pixel. A preferred method to apply the calibration function of FIG. 4 is with a look-up-table (LUT) which receives the pixel-specific desired digital level as an input and provides a corresponding pixel-specific pulse count as an output.

Figure 3:
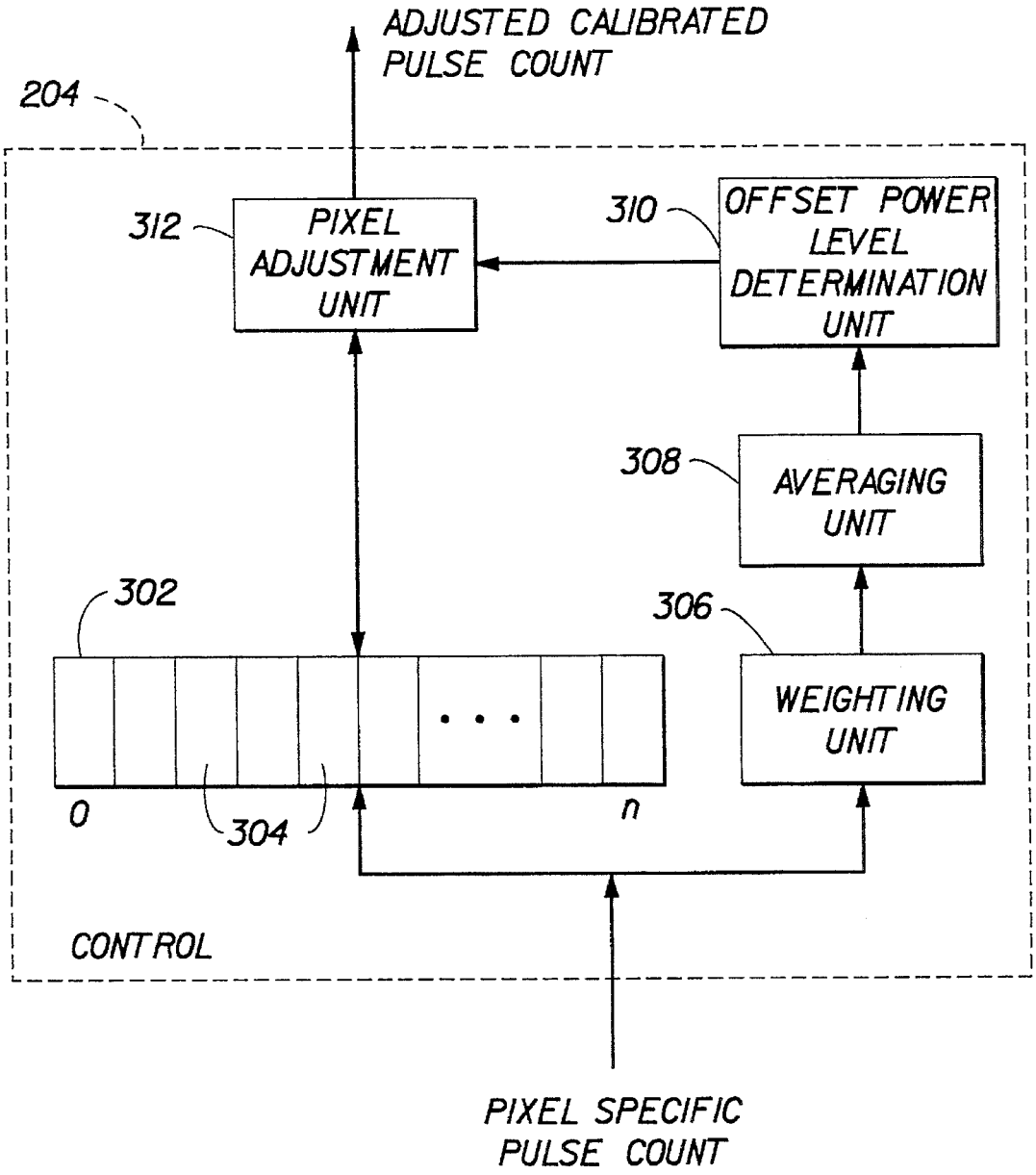
FIG. 3 is a block diagram of the components of a control element of FIG. 2.

The calibration element 202 provides the pixel-specific pulse count output to a control element 204, which receives the required number of pulses and provides a pixel-specific adjusted calibrated pulse count, as detailed in FIG. 3. The adjusted calibrated pulse count is provided to a Print Head Modulator (PHM) 206, which functions in a manner known in the related art. The input to PHM 206 represents the weighted adjustment of how much power in terms of number of pulses each pixel in a print line will receive. The PHM 206 generates and provides a string of signals in a manner well-known in the art, and, under the timing control of input signal clock, loads this string sequentially into shift register 208. Although only one data line is shown for sequential transfer to one group of shift registers as represented by shift register 208, it will be understood that the PHM 206 may generate a plurality of signal outputs 217, which will each transfer data to a separate group of shift registers (not shown), thereby permitting an efficient group-loading of a print head, having typically a plurality of groups of thermal print elements each.

For a print head 210 with print elements 212, the clock signal results in transfer in adjusted calibrated pulse count data from the PHM 206 into the shift register 208 until all of its 'n' stages contain either a high (1) or a low (0) signal level, i.e. state. A latch signal provided by the PHM 206 causes data in each stage of the shift register 208 to be entered into a corresponding stage of a latch 214. A high enable signal provided by the PHM 206 is connected to a corresponding 'NAND' element 216. When a group enable signal is high, a circuit is completed through print elements 212 and the logic 'NAND' elements 216 which have their corresponding latch stages in a high state. In other words, a print element is energized. The pulse duration or pulse width is controlled by the time that the group enable signal is high. It will be understood that the logic 'NAND' elements 216 can also be organized into a plurality of groups, each group receiving a separate enable input 218 from the PHM 206. Activating the enable signals in sequence would reduce current drain on the power supply.

As a result of the operation described above, all of the 'n' print elements 212 have been addressed (enabled) one time. The print element 212 each may have been energized one time, depending on the state of the corresponding stages in latch 214. Now, the shift register 208 will have to be loaded with data 'n' different times. Each group of print elements will be addressed 'n' times for a print line, and each print element 212 will be energized the proportionate number of times corresponding to the level of desired density level for each print element 212. Moreover, while data is being loaded from the PHM 206 to the shift register 208, image data for the next line is simultaneously being received from the control element 204. Therefore, the PHM 206 is receiving new data as previous data is being sent out, thereby effectuating an operation timeshare in the PHM 206.

FIG. 3 illustrates a preferred embodiment of the control element 204, which is important to the present invention. A pixel-specific pulse count input is stored in a line buffer 302 which has 'n' memory addresses 304, each address corresponding to one of the print elements 212 from the print head 210. The pixel-specific pulse count input is also applied to a weighting unit 306, which outputs a pixel-specific weighted pulse count according to a weighting function 502, shown in FIG. 5. A preferred embodiment of the weighting unit 306 is an LUT. The pixel-specific weighted pulse count is stored in an averaging unit 308, which sums all pixel-specific weighted pulse counts from one print line in order to calculate a weighted average pulse count for that print line. This weighted average pulse count is provided to an offset power level determination unit 310, which provides a print-line-specific offset power level output (pulse count correction) according to an adjustment function 602, shown in FIG. 6. A preferred embodiment of the offset power level determination unit 310 is a LUT. The print-line-specific offset power level is received by a pixel adjustment unit 312, which accesses each memory address 304 of line buffer 302 to adjust each stored pixel-specific pulse count according to the print-line offset power level in order to output a pixel-specific adjusted calibrated pulse count. A preferred method of adjusting each stored pixel-specific pulse count according to the print-line offset power level is with a LUT which adjusts a starting address to the LUT in accordance with the offset power level provided to the LUT. The output of the LUT is then utilized in a table index to access a specified memory address 304 of line buffer 302.

FIG. 4 illustrates the operation of a LUT used in a preferred embodiment of the calibration element 202. The X axis of the graph of FIG. 4 represents the desired digital level input signal as is applied to the input of a LUT of the calibration element 202; the Y of the same graph axis represents the output from the same LUT. The maximum density $D_{max}$ is represented by a maximum desired digital level, which is typically 2.3 when the receiver material is paper. The minimum density $D_{min}$ is represented by a minimum desired digital level, which is typically 0. The calibration function represented by curve 402 can be determined experimentally to translate effectively the inputted desired digital level value into a pixel-specific pulse count needed to achieve the desired density. The curve 402 signifies that a desired digital level approximating $D_{min}$ will be translated to a low pulse count and a desired digital level equal to $D_{max}$ will translate to the maximum number of pulses, which is $2^m-1$, where m represents the number of color data bits in the printer system.

Figure 5:
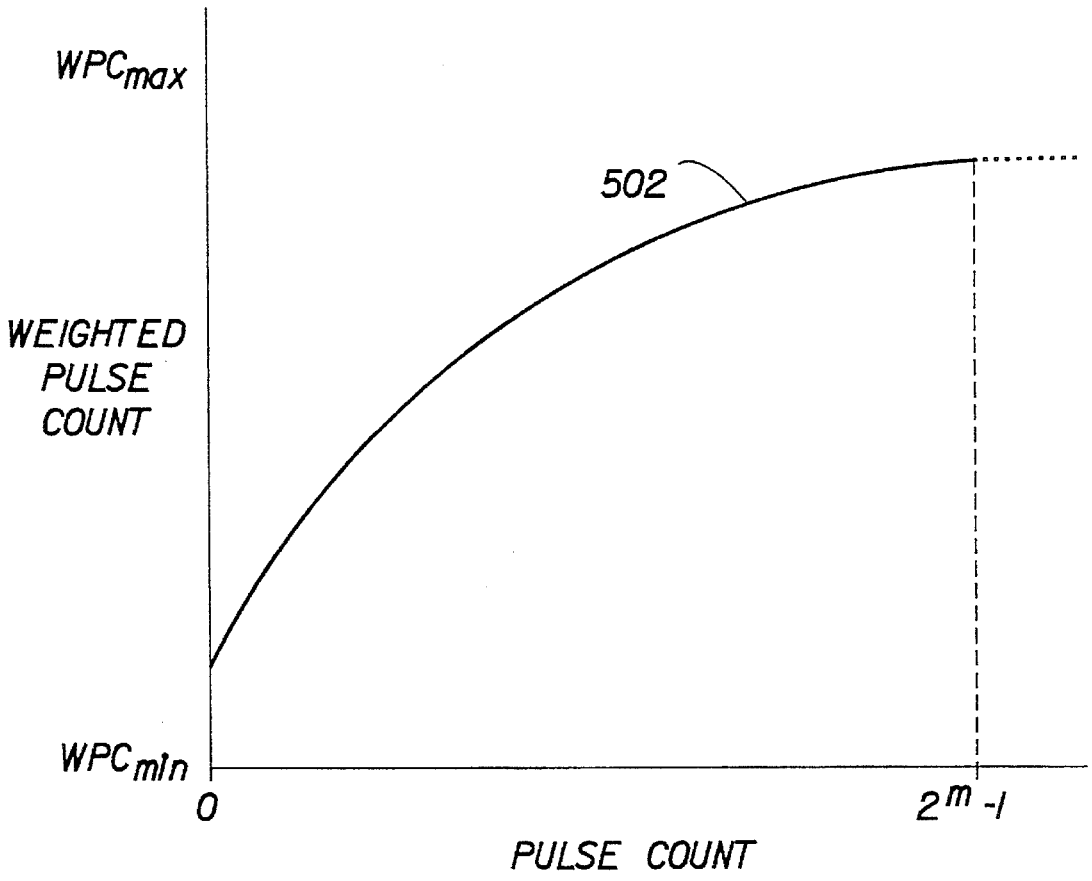
FIG. 5 is a plot of the function used by a weighting element to translate a pixel-specific number of pulses input into a weighted pulse count, in accordance with the present invention.

FIG. 5 illustrates the operation of a LUT used in a preferred embodiment of the weighting unit 306. The X axis of FIG. 5 represents the pulse count output that was provided from the calibration element 202 and is applied to the input of a LUT of weighting unit 306; this number ranges from 0 to $2^m-1$, where m represents the number of color data bits in the printer system. The Y axis represents the weighted pulse count, which is provided from the LUT of weighting unit 306; the range of the Y axis is an arbitrary range that is determined by the desired relationship of the pulse count to the weighted pulse count generated by the LUT.

Figure 6:
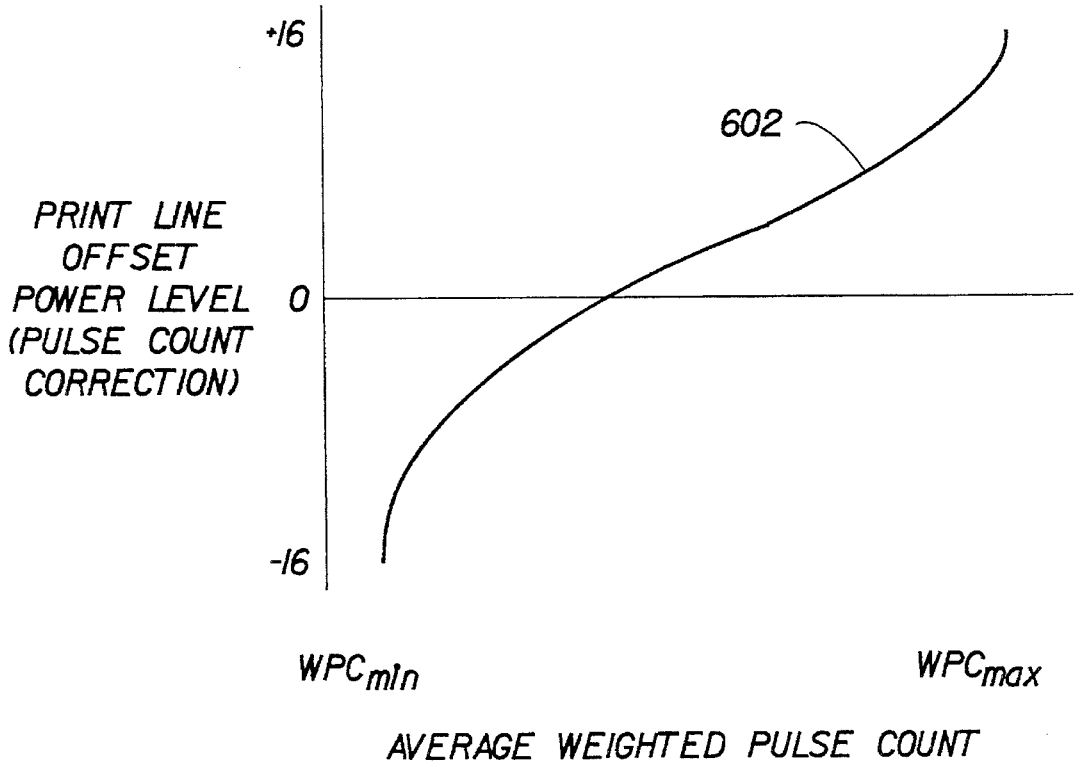
FIG. 6 is a plot of the function used by an offset power level determination unit of FIG. 3 to determine a print-line offset power level for a weighted average of a specific print line, in accordance with the present invention.

FIG. 6 illustrates the operation of a LUT used in a preferred embodiment of the pixel adjustment unit 312. The X axis of the graph of FIG. 6 represents the average of the weighted pulse counts for all of the 'n' print elements; the range of this axis is consistent with the arbitrary range selected for the Y axis of the graph of FIG. 5. The Y axis of the graph of FIG. 6. represents the print-line offset power level, or pulse count correction, that will be added to each memory address 304 of line buffer 302 to determine the pixel-specific adjusted calibrated pulse count. The Y axis of FIG. 6 shows a range of −16 to +16, but it is understood that this range may be increased or decreased without impacting the performance of the present invention. In a preferred embodiment, the X axis of the graph of FIG. 6 represents the LUT address; the Y axis of the same graph represents the pulse count correction.

As described, the present invention addresses pulse count variations to compensate for the power supply loading effect caused by energizing a plurality of heating elements in a print head. As such, the actual printed density of a heating element or pixel is related to the desired pixel density plus the print-line offset power level described in FIGS. 3 and 6 and as shown in Equation 3:

$$D_{Desired}=f(PC) \quad \text{(Eqn. 1)}$$

$$D_{Actual}=f'(PC) \quad \text{(Eqn. 2)}$$

$D_{Desired}$=desired print density $D_{Actual}$=actual print density

PC=Pulse Count before correction f(x)=functional relation of pulse count and desired pixel density f'(x)=functional relation of pulse count and actual pixel density Therefore, after correction, $$D_{Actual}=f'(PC+\Delta)\approx D_{Desired} \quad \text{(Eqn. 3)}$$

where

Δ=Pulse count correction needed to generate the required print-line offset power level Δis related to: 1) the number of heating elements enabled; 2) the power supply characteristics; and 3) the design of the power distribution system.

Now, suppose the pulse count correction is expressed as a function of the average desired pixel density for a print-line, as shown in Equation 4 below:

$$\Delta=f_2(D_{Average}) \quad \text{(Eqn. 4)}$$

where $D_{Average}$=average density of print-line

The average density of the print- line is shown in Equation 5:

$$D_{Average}=(\Sigma Dp)/n \quad \text{(Eqn. 5)}$$

where

Dp=density of each pixel in a print line n=number of pixels in a print line

Figure 7:
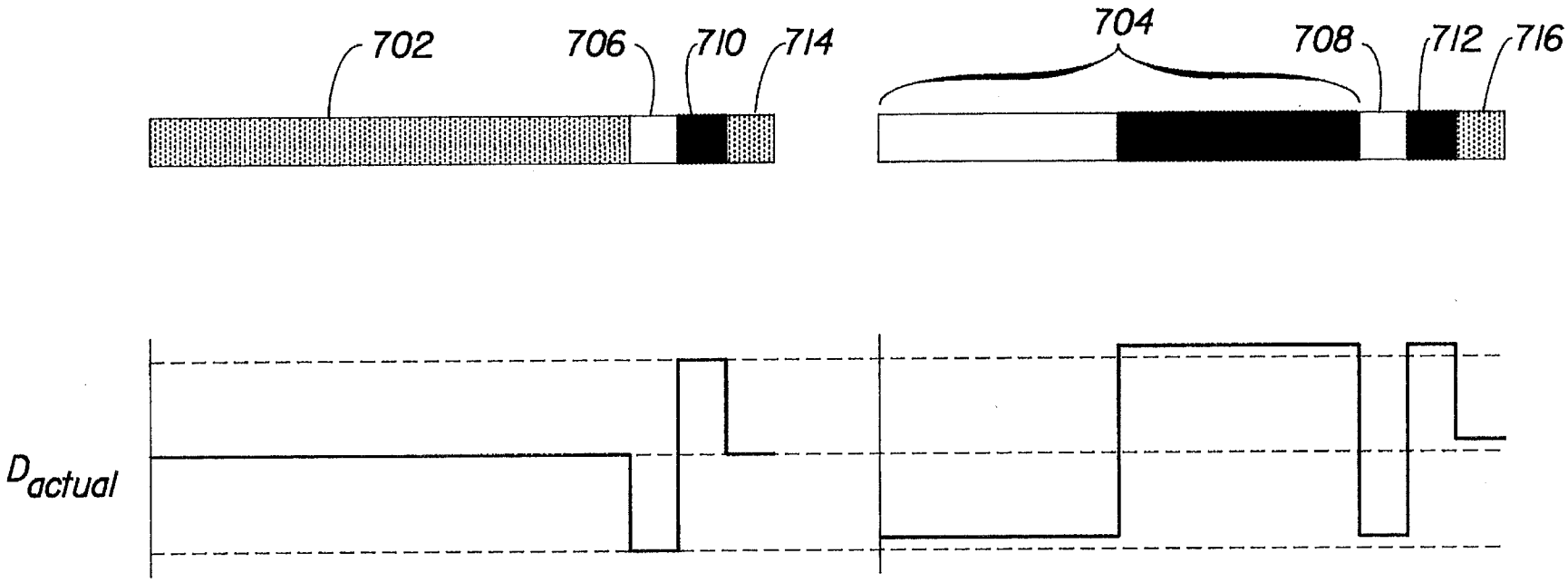
FIG. 7 shows the difference between the desired density and the actual achieved density after compensating for parasitic voltage drops by using the average digital level as a reference.

However, when using the average density of the print line shown in Equation 5 without a weighting factor, a mismatch between the desired density and the actual density is sometimes encountered, as shown in the comparison between line 702 and line 704 of FIG. 7. This figure compares how print lines with different desired densities are printed when using the average density of the print line as a reference for pulse count correction. Line 702 is composed of pixels of a uniform grey density while line 704 are composed of half-black-and-half white pixels. Each of these lines has the same average density. Further, lines 702 and 704 each contain corresponding similar reference pixels of various densities. Reference pixels 706 and 708 are of similar low density; reference pixel 710 and 712 are of similar high (shown as a black color) density; and reference pixels 714 and 716 are of similar density (shown as a grey). If the change in print head voltage due to parasitic effects between grey and white is not exactly compensated by the change in going from grey to black, the actual densities of the reference pixels will be different in the two cases. This difference is shown in the plots of actual density in FIG. 7. Since both lines have the same average density, any compensation based on this average cannot correct this effect.

This initial density compensation effort is only partially successful because power variations are not linear with density. For example, a grey line (line 702) may have a different power supply load than a desired printed line which is half-white-and-half-black (line 704), even though both lines have the same average density. Since both lines have the same average densities, Eqn. 7 gives the same power level for both lines. However, the power supply loads for each line are different and each requires a different offset power level value.

Therefore, the pulse count correction function of FIG. 6 must necessarily account for the fact that the power supply loads for each line are different and require a different offset power level value. As such, in accordance with the present invention, the printing variations produced by using the pulse count correction function of FIG. 6 can be better compensated by weighting the desired pulse counts prior to applying the pulse count correction function of FIG. 6. In this manner, provision can be made for the different power supply loads that require a different offset power level value. This weighting of desired pixel levels is accomplished by replacing Eqn. 5 with Eqn. 6, shown below:

$$D_{WA}=(\Sigma f_3(Dp))/n \quad \text{(Eqn. 6)}$$

where $f_3$(Dp)=a weighted function of the pulse count for each pixel

Instead of using the average density of the print line as done in Equation 5, Equation 6 uses a weighted density method as a reference. Here, each desired pulse count of a pixel is modified by the application of weighting according to the weighting function 502 of FIG. 5. This weighting function 502, has values which compensate for and are determined according to the values of the response of the specific manufacturer's brand of power supply and power distribution system. The weighted pulse counts are then averaged by the application of Equation 6 in order to yield a weighted average pulse count of a print line that can then be used in Equation 4 to calculate an offset power level that appropriately accounts for the fact that the power supply loads for each print line are different.

Utilizing, for illustration purposes, the identical desired print Lines 1 and 2 of FIG. 7, by using the desired pulse count as a reference and appropriately weighting this input with weighting function 502, power variations can be accounted for in the computations, thereby eliminating the difference in actual density experienced in the corresponding plots of actual density shown in FIG. 7. For example, the low density pixels (reference pixels 706 and 708) may be weighted differently than the high density pixels (reference pixels 710 and 712), resulting in a different weighted average than in lines 702 and 704; therefore, a different pulse count correction is achieved. Hence, since the offset power levels are different when the power supply loading changes, a better digital level compensation is achieved.

2. Operation of the Preferred Embodiment

A pixel-specific desired digital level quantifies an amount of dye desired to be transferred to the media at the pixel; therefore, a desired digital level represents a known intensity of printing that is desired for each pixel. This pixel-specific desired digital level is calibrated for use according to the present invention by determining a corresponding number of pulses to be applied to the specific pixel. In a preferred embodiment of the present invention, upon receipt of a WRITE signal, the pixel-specific desired digital level is applied to a calibration look-up-table (LUT) to determine the number of pulses for that pixel. This pixel-specific number of pulses is stored in the pixel-specific memory address of a line buffer, which has one memory address for each of the 'n' pixels in a printed line. Once the number of pulses is stored, an ACKNOWLEDGE output signal is provided to indicate that the WRITE operation has occurred. For the first print line, this sequence is repeated 'n' times until each memory address of the line buffer has been filled with a number of pulses for each pixel in that line.

As the line buffer for the first print line is filled, the pulse counts are weighted and summed to ultimately determine an offset power level that will be added to or subtracted from each pixel-specific number of pulses to compensate for the specific parasitic resistance that will be experienced by the print circuit when all of the pixels in that line are activated during printing. To determine this offset power level, the first pixel-specific number of pulses is weighted and added to the total. In a preferred embodiment, this weighting is accomplished by applying the pixel-specific number of pulses to a weighting LUT which provides a corresponding weighted pulse count for that pixel. The weighting LUT accounts for all of the values in the line buffer and minimizes the time required for this weighting operation. The weighted pulse count for the first pixel is stored to be summed with each of the weighted pulse counts of the remaining pixels in the print line. This sequence is repeated until all pixel-specific number of pixels have been weighted and subsequently summed to calculate the total weighted pulse count value that will be used by all of the 'n' pixels in the print line. The total weighted pulse count value is then divided by 'n' (the number of pixels) to determine the weighted average for each pixel. This weighted average is used to determine the pulse count correction (offset power level) to be added to or subtracted from each pixel-specific number of pulses. The application of the offset power level to each pixel-specific number of pixels stored in the line buffer determines the adjusted calibrated pulse count of each pixel. The adjusted calibrated pulse count is the pixel-specific number of pulses for the parasitic resistance experienced by the plurality of pixels activated simultaneously on the print line.

The offset power level should not produce an adjusted calibrated pulse count which is less than the minimum number of pulses for a pixel (typically zero) or which is greater than the maximum number of pulses for a pixel (typically $2^m-1$ where m is the number of bits specifying the color options of the printer apparatus). Therefore, where the adjusted calibrated pulse count will be less than zero or greater than $2^m-1$, it will be limited to be zero or $2^m-1$ respectively. In a preferred embodiment, a parasitic resistance LUT is utilized to maximize the speed at which the adjusted calibrated pulse count is calculated with any required limiting. This pixel-specific adjusted calibrated pulse count is then delivered to a corresponding memory address of a Print Head Modulator (PHM) line buffer. It is well-known in the art that the PHM operates with two line buffers: one buffer prints while the other buffer fills, and these functions alternate between filled buffers.

Once the offset power level is determined, a timeshare operation which minimizes the timing demands on the controlling computer of the printer apparatus is activated. This timeshare operation alternates between: a) accessing a memory address of the line buffer to be applied to the Parasitic Resistance Compensation LUT for ultimate calculation of an adjusted calibrated pulse count; and b) receiving a corresponding new desired digital level to be applied to the calibration LUT to displace ultimately the current value in the current memory address of the line buffer. In this manner, each memory address provides a currently stored pixel-specific number of pulses to be compensated by the offset power level in the Parasitic Resistance Compensation LUT. After compensation, a resulting adjusted calibrated pulse count is delivered to the PHM for storage. The Calibration LUT simultaneously receives a new desired digital level to be converted into a new line's pixel-specific number of pulses to displace the current line's value in the recently accessed memory address of the line buffer. Each time the line buffer is filled with values from a new print line, the summed value used to calculate the weighted average for a printed line is set to zero so that the process of calculating a weighted average and offset power level for that new line can be implemented. This timeshare operation efficiently permits multiple operations to occur simultaneously and spreads the demand for new desired digital levels over a longer period, thereby reducing the demands on the printer apparatus supplying the desired digital level inputs.

Those skilled in the art will recognize that although look-up-tables (LUTs) have been described in preferred embodiments to achieve the speed required for the computations, it will be understood that the present invention is not limited to the use of LUTs, but can be implemented with addressable memories or similar devices.

The foregoing description is included to illustrate the operation of the preferred embodiment and is not meant to limit the scope of the invention. The scope of the invention is to be limited only by the following claims. Although preferred embodiments of the invention have been described in conjunction with driving thermal print elements, it will be understood that the principles of the invention may be extended to driving other print elements, e.g. other resistive load print elements. From the foregoing description, many variations will be apparent to those skilled in the art that would yet be encompassed by the spirit and scope of the invention.

What is claimed is:

1. A thermal printer system comprising:

a plurality of thermal print elements coupled between first and second terminals, said thermal print elements arranged for printing of an image represented in a data signal;

power supply means coupled to said first and second terminals for supplying current to said print elements; and control means for applying a selected pulse count to said thermal print elements, said control means including:

modifying means for modifying said selected pulse count in a manner determined by a total pulse count supplied to said thermal print elements during a print period, wherein said modifying means further includes (1) memory means for storing said selected pulse count, (2) weighting means coupled to said memory means for producing a pixel-specific weighted pulse count which is representative of an energy to be applied to each of said thermal print elements, and (3) averaging means coupled to said weighting means for determining an average of pixel-specific weighted pulse counts.

2. The thermal printer of claim 1 wherein said modifying means further includes adjustment means coupled to said averaging means for determining an offset power level value.

3. The thermal printer of claim 2 wherein said modifying means further includes compensation means coupled to said adjustment means and said memory means for adjusting each pulse count with said offset power level value to determine a pixel-specific adjusted calibrated pulse count.

4. The thermal printer of claim 3 wherein said modifying means further includes modulation means coupled to said compensation means and said plurality of thermal print elements for applying each of pixel-specific adjusted calibrated pulse counts to each thermal print element of said plurality of thermal print elements.

5. The thermal printer of claim 3 wherein said modulation means is a look-up-table.

6. The thermal printer of claim 2 wherein said compensation means is a look-up-table.

7. The thermal printer of claim 1 wherein said pulse count is calibrated from a desired digital level input.

8. The thermal printer of claim 1 wherein said weighting means is a look-up-table.

9. The thermal printer of claim 6 wherein said adjustment means is a look-up-table.

10. The thermal printer of claim 1 wherein said memory means is a line buffer.

11. A method for use in a thermal printer system which prints an image on a receiver medium by supplying energy to a number of thermal print elements coupled between first and second power terminals and arranged for printing of the image, wherein a supplied energy to each of the thermal print elements is compensated in response to parasitic voltage drops, said parasitic voltage drops being related to the number of said thermal print elements activated during a first print period, said parasitic voltage drops varying as said number of thermal print elements activated varies from said first print period to a second print period, said method comprising the steps of:

determining a weighted average value of the current pulses according to a predetermined weighting function:

calculating an offset power level value from a weighted average value of the current pulses to be distributed among said print elements in a print line; and adjusting a pulse count to be applied to each of said thermal print elements with the calculated offset power level value.

12. A method as set forth in claim 11 wherein said weighted average value is determined by obtaining a pixel-specific weighted pulse count for each pixel-specific pulse count by applying said weighting function to each pixel-specific pulse count; and averaging said pixel-specific weighted pulse counts.

* * * * *

UNITED STATES PATENT AND TRADEMARK OFFICE

CERTIFICATE OF CORRECTION

PATENT NO. : 5,469,203
DATED : November 21, 1995
INVENTOR(S) : Edward Hauschild

It is certified that error appears in the above-indentified patent and that said Letters Patent is hereby corrected as shown below:

Claim 6, Column 11, line 26, after "claim" delete "2" and insert --3--.

Claim 9, Column 11, line 32, after "claim" delete "6" and insert --2--.

Signed and Sealed this

Twenty-seventh Day of August, 1996

*Attest:*

Bruce Lehman

BRUCE LEHMAN

*Attesting Officer*

*Commissioner of Patents and Trademarks*